US007347015B2

(12) United States Patent
Keeb et al.

(10) Patent No.: US 7,347,015 B2
(45) Date of Patent: Mar. 25, 2008

(54) CONDUCTOR MARKING DEVICE WITH RECEIVING POCKETS

(75) Inventors: Thomas Keeb, Lage (DE); Torsten Bett, Bielefeld (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 318 days.

(21) Appl. No.: 11/126,193

(22) Filed: May 11, 2005

(65) Prior Publication Data

US 2006/0010736 A1 Jan. 19, 2006

(30) Foreign Application Priority Data

May 13, 2004 (DE) ..... 20 2004 007 814 U
Jul. 30, 2004 (DE) ..... 20 2004 011 922 U

(51) Int. Cl.
*G09F 3/20* (2006.01)
*G09F 3/18* (2006.01)

(52) U.S. Cl. ..... 40/316; 174/112; 138/104

(58) Field of Classification Search ..... 40/316, 40/658, 660, 665, 666; 138/104; 174/112; 439/489, 491

See application file for complete search history.

(56) References Cited

U.S. PATENT DOCUMENTS 3,534,777 A * 10/1970 Loof ..... 138/121
4,268,986 A * 5/1981 Piana ..... 40/316
4,876,810 A * 10/1989 Piana et al. ..... 40/316
4,899,474 A * 2/1990 Piana et al. ..... 40/316
5,078,829 A * 1/1992 Morosini ..... 156/584
5,111,605 A * 5/1992 Bossi ..... 40/316
D346,624 S * 5/1994 Skarin ..... D20/43
5,606,813 A * 3/1997 Cornu et al. ..... 40/316
6,729,438 B1 5/2004 Perrett
6,763,623 B2 * 7/2004 Piana ..... 40/316
6,843,008 B2 * 1/2005 Mellgren ..... 40/316
6,935,057 B2 * 8/2005 Piana ..... 40/316

FOREIGN PATENT DOCUMENTS

DE 40 17 945 A1 12/1991
DE 42 32 620 A1 3/1994
EP 568510 A1 * 11/1993
FR 2625824 A1 * 7/1989
FR 2638879 A1 * 5/1990
WO WO 8911153 A1 * 11/1989

* cited by examiner

*Primary Examiner*—James R. Brittain
*Assistant Examiner*—Ruth C. Rodriguez
(74) *Attorney, Agent, or Firm*—Lawrence E Laubscher, Sr.; Lawrence E Laubscher, Jr.

(57) ABSTRACT

A marking device for identifying an electrical conductor includes a planar generally annular marker body containing at least one opening for receiving the conductor, and a plurality of coplanar outwardly extending portions containing mutually isolated pockets for receiving planar indicia-bearing tags, respectively. In one embodiment, the body is deformable and contains at least two creased portions that permit adjustment of the size of the opening to correspond with the diametrical size of the conductor that is to be identified.

4 Claims, 9 Drawing Sheets

CONDUCTOR MARKING DEVICE WITH RECEIVING POCKETS

BACKGROUND OF THE INVENTION

1. Field of the Invention

A marking device for identifying an electrical conductor includes a planar generally annular marker body containing at least one opening for receiving the conductor, and a plurality of coplanar outwardly extending portions containing mutually isolated pockets for receiving planar indicia-bearing tags, respectively. In one embodiment, the body is deformable and contains at least two creased portions that permit adjustment of the size of the opening to correspond with the diametrical size of the conductor that is to be identified.

2. Description of the Related Art

As evidenced by the prior Perrett U.S. Pat. No. 6,729,438, and the German published applications Nos. DE 4017945 and DE 4232620, it is well known in the prior art to provide marking devices that are attached to articles and contain pockets for receiving indicia-bearing cards or tags which identify that article. It is also known that one can subdivide the receiving pocket by a bridge portion into two directly adjoining chambers in order to house a pair of two insertion tags.

The present invention was developed to improve the viewability of the markers for an observer, such as an assembler of electrical equipment.

BRIEF SUMMARY OF THE INVENTION

Accordingly, a primary object of the present invention is to provide an improved marking device including a generally annular planar marker body containing at least one central opening for receiving the electrical conductor that is to be marked, and a plurality of outwardly extending portions that contain pockets that are isolated from each other and that receive indicia-bearing identifying tags, respectively.

According to another object of the invention, the marker body includes an inwardly creased portion that defines an opening that permits lateral mounting of the marking device on a conductor.

A more specific object of the invention is to form the body from a deformable material and to provide at least two creased portions that permit adjustment of the size of the central opening to correspond with the size of the conductor that is to be marked. Preferably the creased portions are located diametrically opposite each other on the marker body. In this manner, by using simple means, one can make a conductor marking sleeve into which, in a simple manner, one can slide conductors with particularly different diameters, offering good all-around viewability of the markers.

A further object of the invention is to provide on the marking device a plurality of pockets for receiving a plurality of insertable indicia-bearing tags, respectively, the pockets being isolated so that the tags do not touch each other and do not directly merge into each other in the manner of mutually adjoining chambers. Accordingly, the improved markers of the present invention function in a simple manner and without any additional cost to guarantee good viewability of the tags from various directions, in particular, also from opposite directions.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
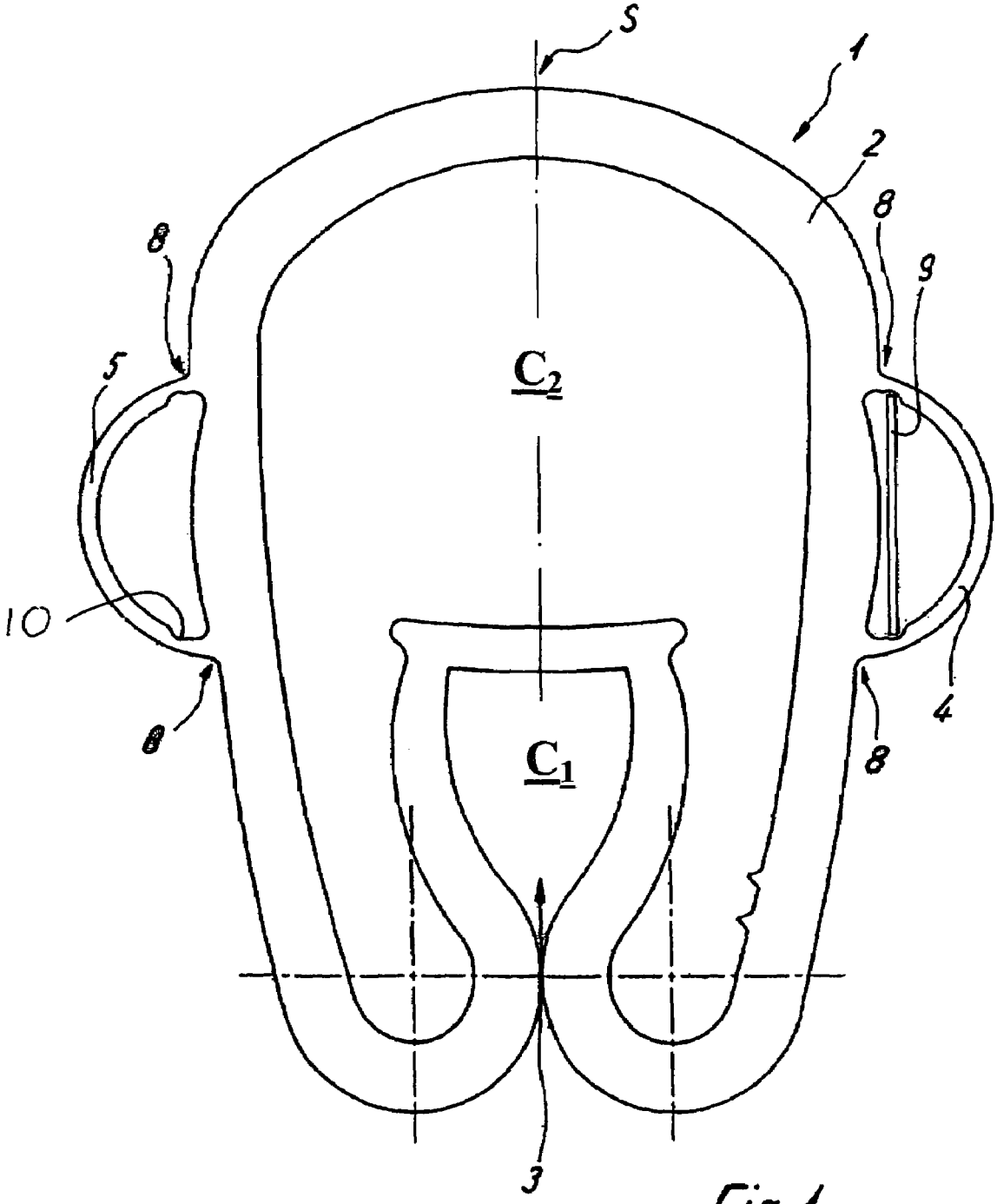
FIG. 1 is a front elevation view of the electrical conductor marking device of the present invention.

Referring first more particularly to FIG. 1, the conductor marking device 1 of the present invention includes a planar unitary generally-annular marker body member 2 that is preferably formed from a deformable synthetic plastic insulating material. The body contains an inwardly creased portion 3 that defines in said body member a first opening $C_1$ that is adjacent the larger body opening $C_2$. An electrical conductor of relatively small diameter that is to be marked for identification may be laterally inserted into the opening $C_1$ via the crease of the creased portion 3. Alternatively, a conductor of larger diameter may be inserted axially into the larger opening $C_2$.

According to the present invention, a plurality of integral body portions 4 and 5 are provided that extend outwardly from the circumference of the body and which respectively contain pockets or pouches that are isolated from each other and from the inner openings $C_1$ and $C_2$. In the embodiment illustrated in FIG. 1, the pocket containing portions are displaced at an angle o 180° relative to each other on the circumference of the body 2. The pockets are adapted to receive and support transversely arranged indicia-bearing tags or plates 9, respectively, thereby to identify the conductor.

The receiving pockets 4 and 5 are placed directly upon basic body member 2 in the manner of a circular segment where the contact areas 8 of the receiving pouches 4, 5 upon basic body member 2 do not touch each other or do not directly merge into each other in the manner of chambers that mutually adjoin each other. In this way, one can make sure that the receiving pockets 4 and 5 will be so spaced apart from each other and distributed on the outside circumference of the body members 2 that the indicia-bearing tags will be clearly viewable from definitely different directions in contrast to chambers that directly adjoin each other.

The angle by which the receiving pockets 4 and 5 are staggered with respect to each other on the outer circumference of basic body member 2 can be greater than, equal t, or less than 180° and can amount, for example, to only 90°. It is advantageous that at least two or all of the receiving pockets 4 and 5 do not directly merge into each other on the outer circumference in order to guarantee a sufficient interval on the outer circumference of the basic body member 2, something that results in improved viewability of the marking tags 9 on the conductor.

Figure 2:
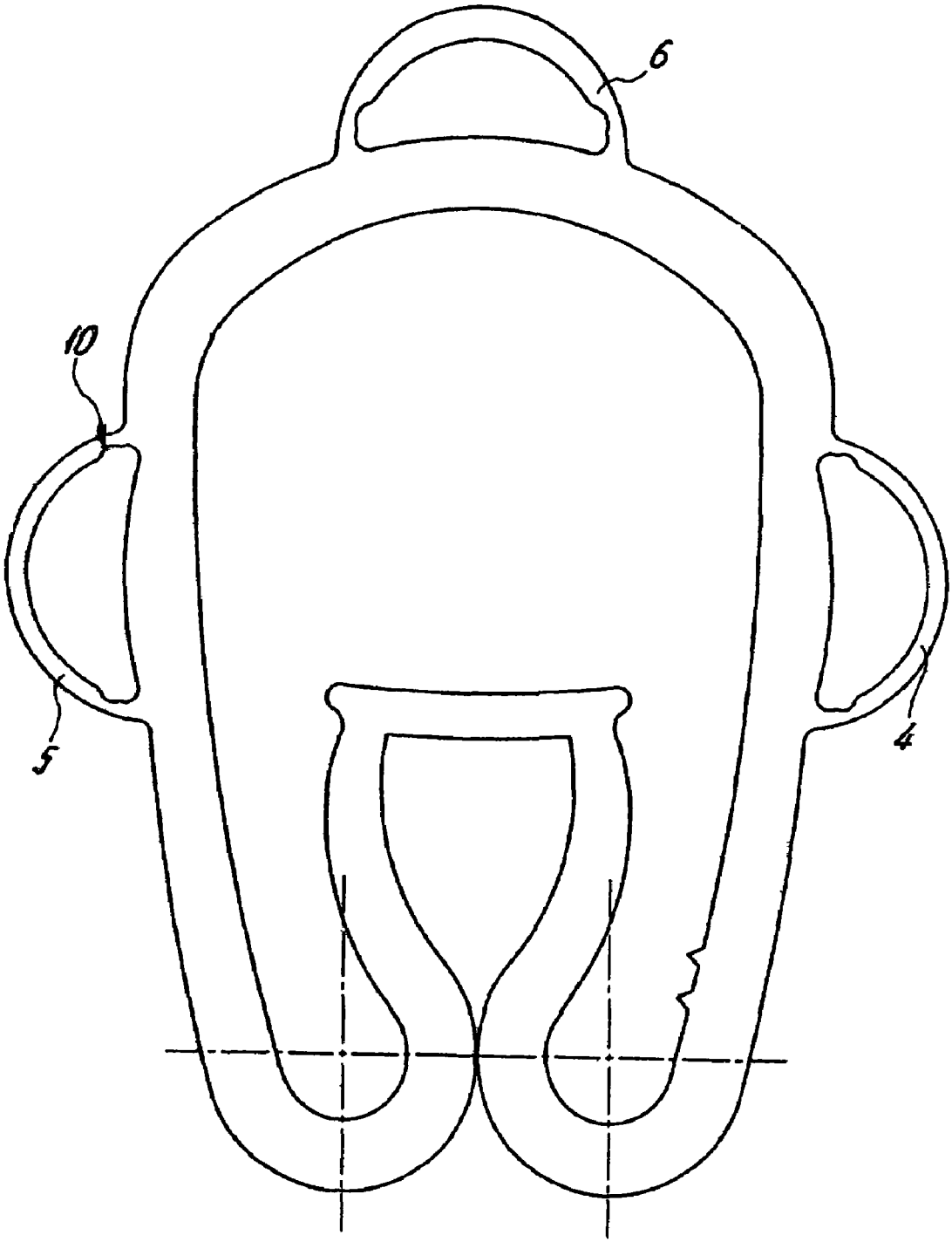
FIGS. 2-8 are front elevation views of various modifications of the conductor marking device of FIG. 1.
Figure 3:
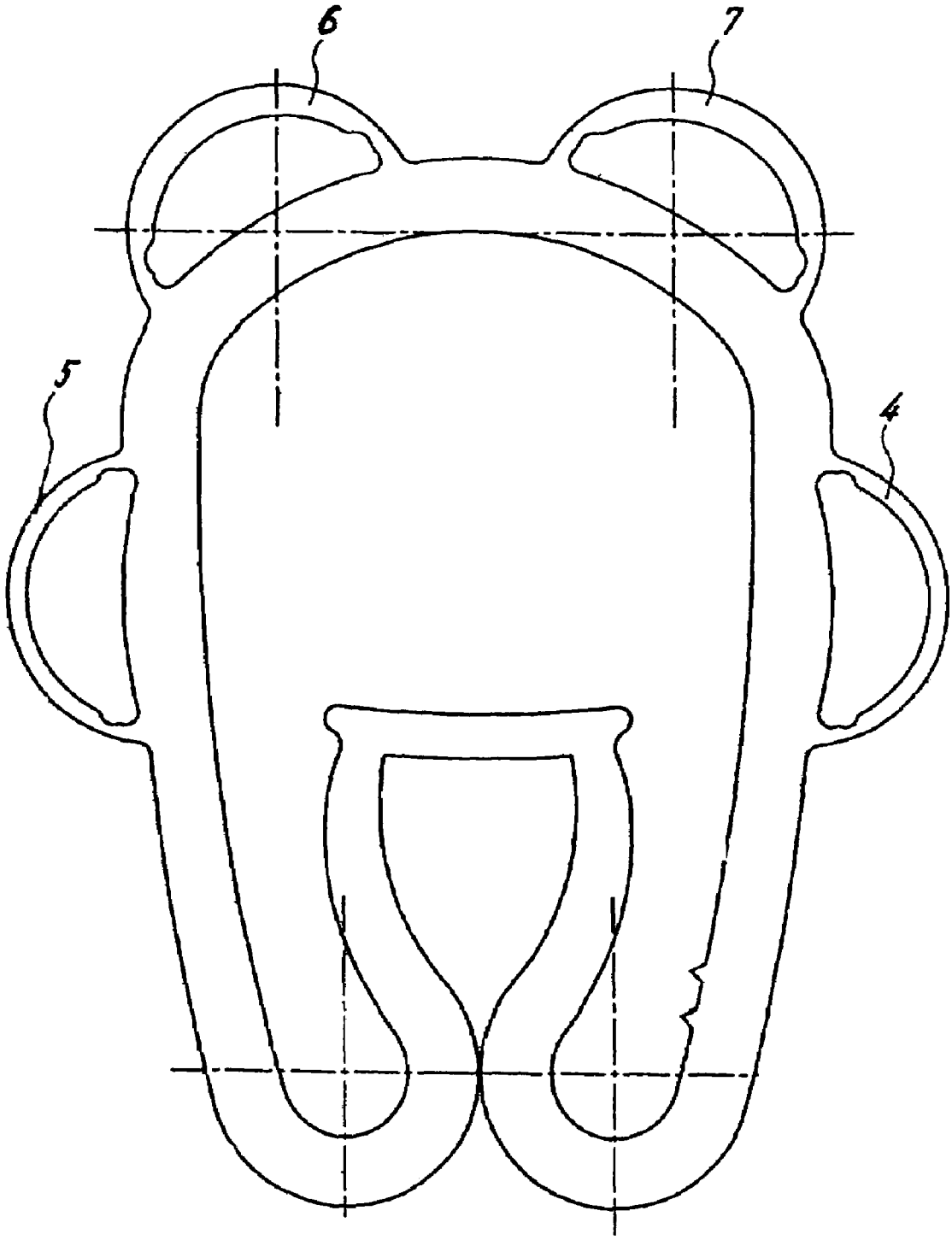

According to alternative embodiments of the invention, it is also possible to distribute more than two, in particular, three (FIG. 2) or four (FIG. 3) receiving popocket portions 4, 5, 6 and 7 along the outer circumference of the marker body.

Preferably, the integral indicia tag receiving pocket portions 4, 5, 6 and 7 are made of transparent synthetic substance and are arranged and distributed on the basic body 2 in the area that is opposite the creased portions 3.

Figure 4:
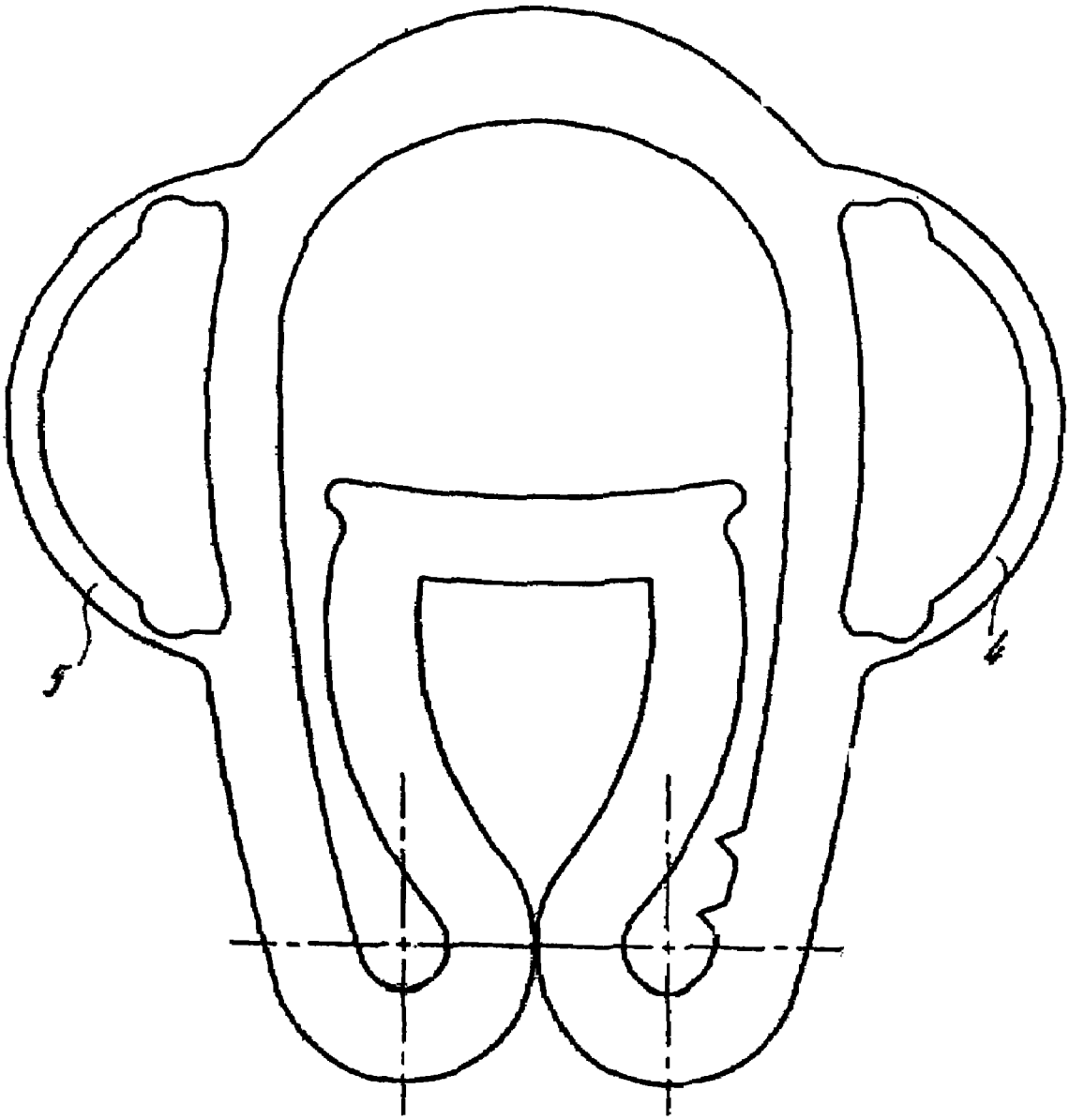
Figure 5:
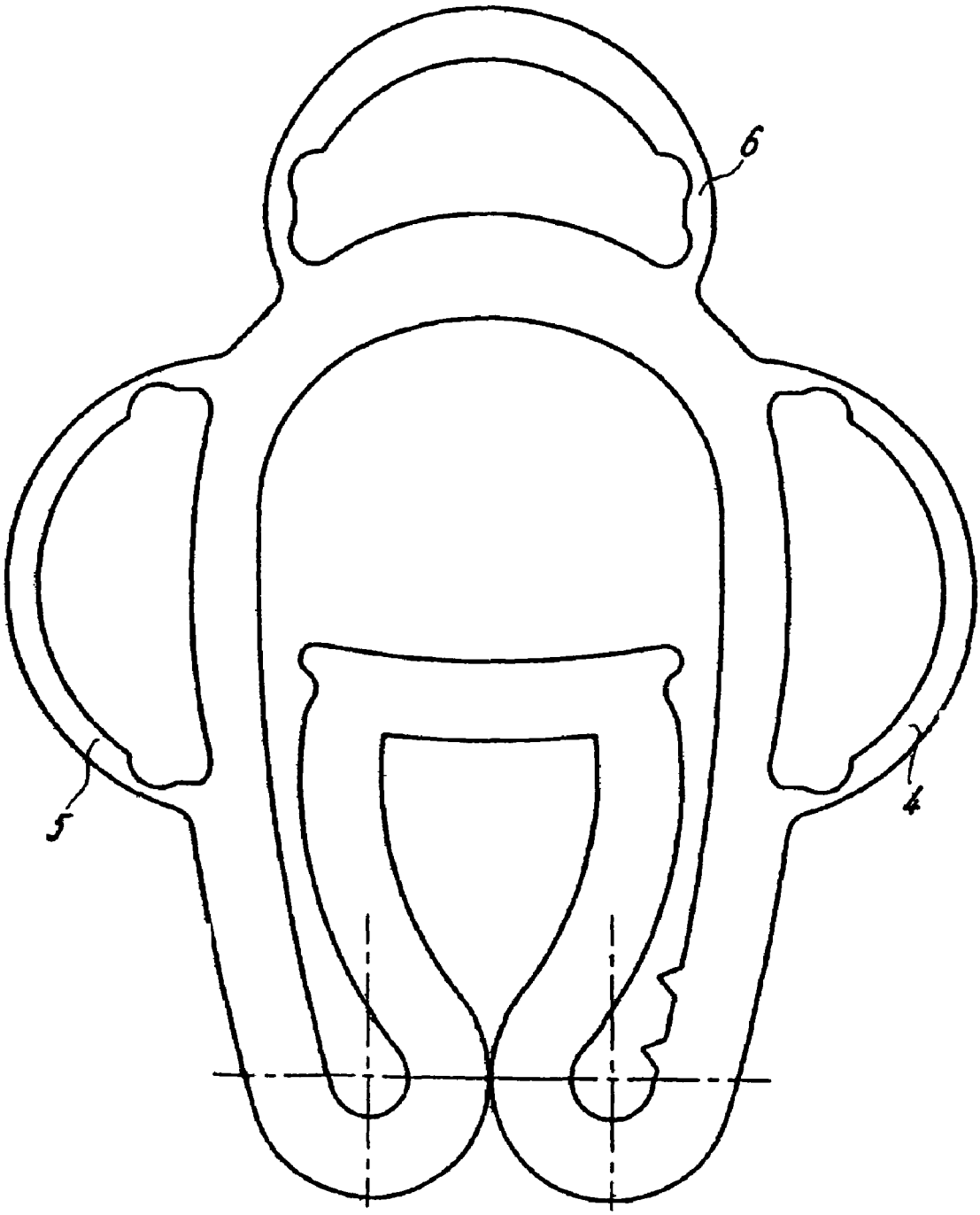
Figure 6:
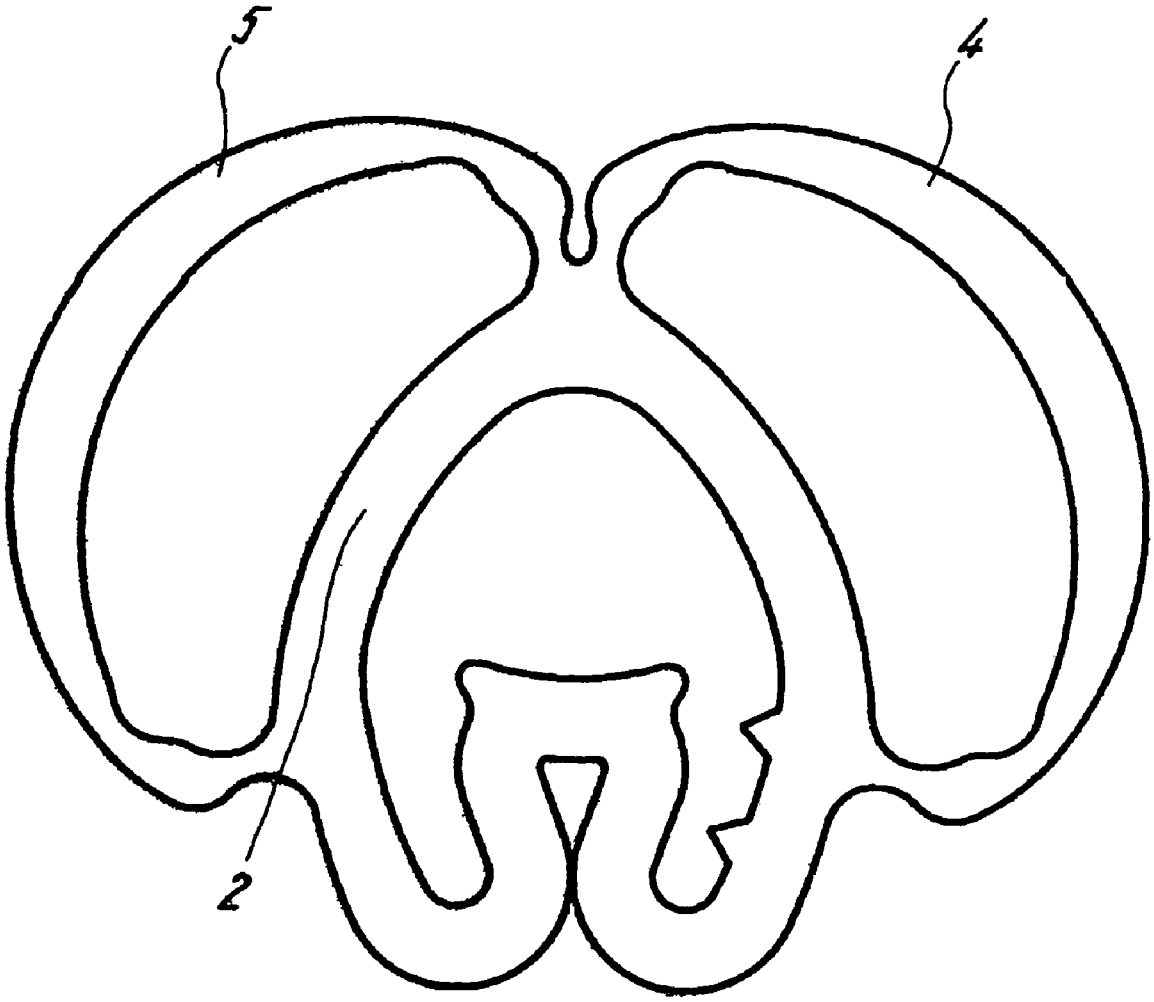

Depending on the intended purpose, the receiving pocket portions can be made larger or smaller, or they can always be equally large so that one can always insert marking tags 9 of the same size. The size and shape of the basic marker body 2 can vary according to the particular purpose and the size and type of conductor (see FIGS. 1, 4 and 6) with basic bodies that display a more or less U-shaped or V-shaped cross-section geometry in the area of receiving pocket portions 4, 5, 6 and 7 and that are partly also suitable for different conductor cross-sections.

Figure 7:
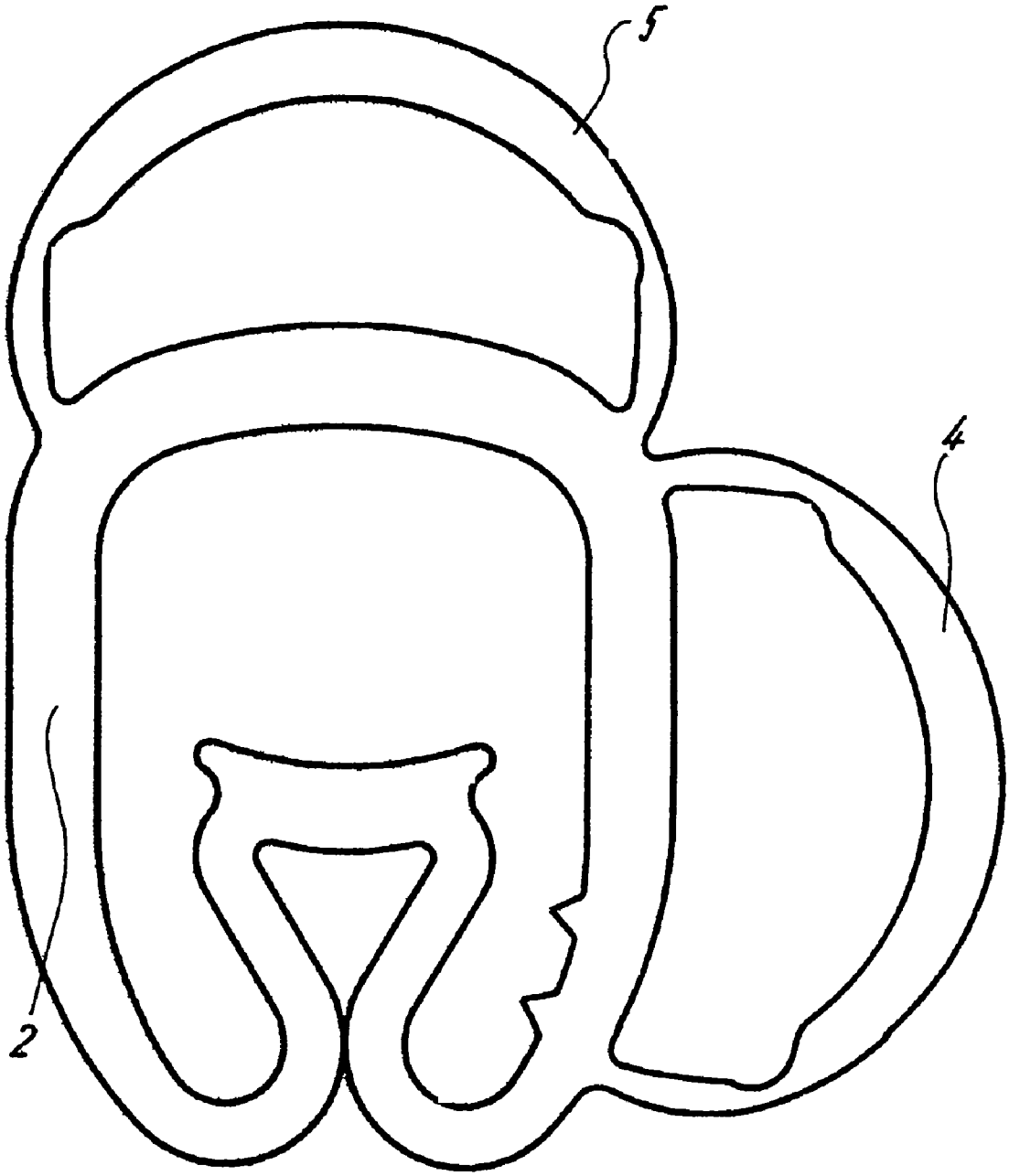
Figure 8:
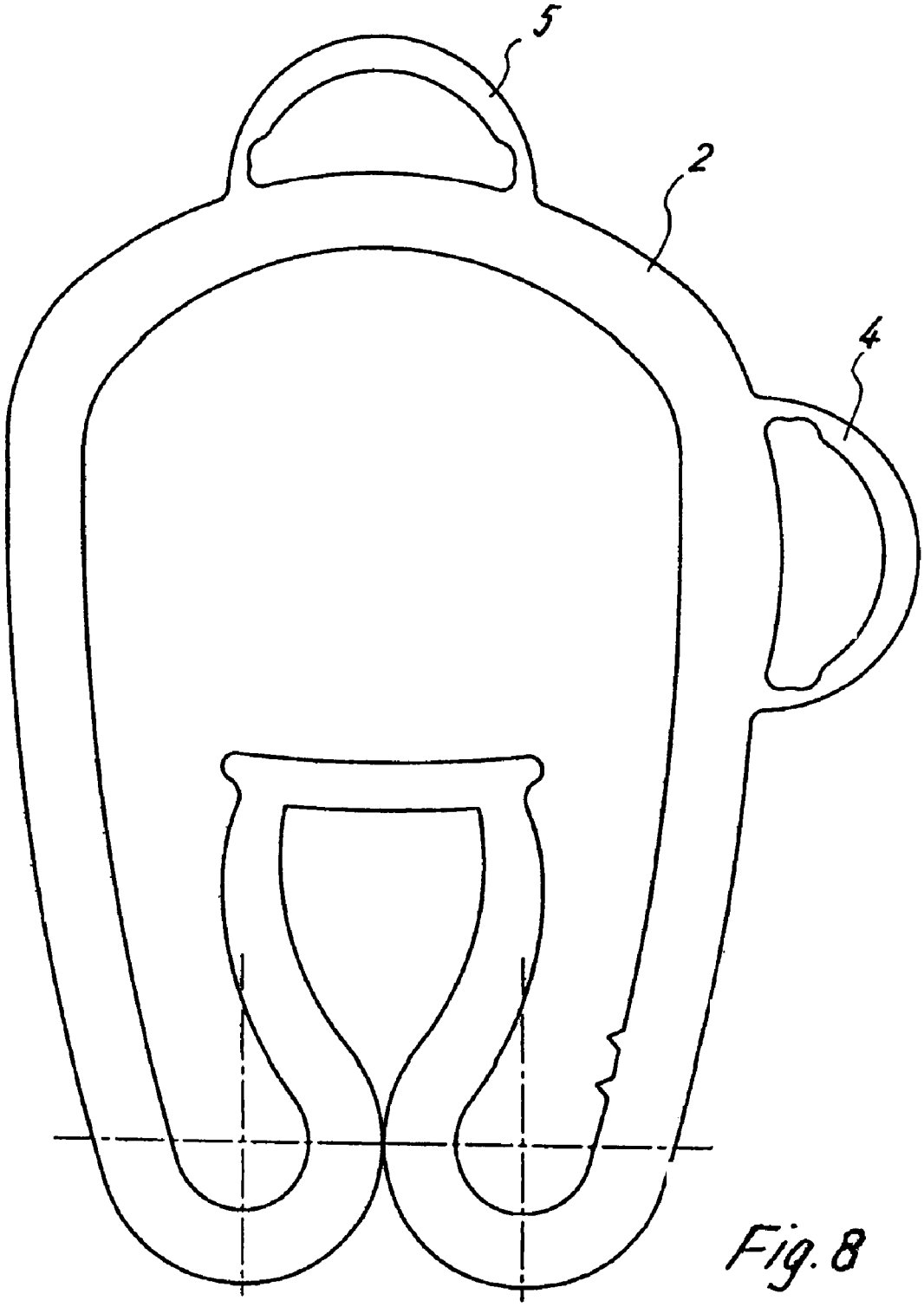
Figure 9A:
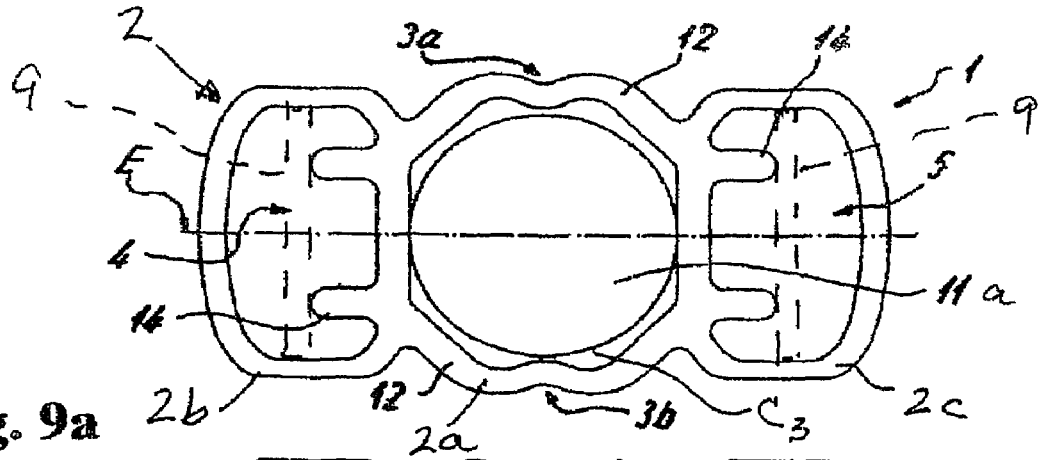
FIGS. 9*a*-9*d* illustrate the manner of deforming the marker body to adjust the size of the conductor receiving opening in accordance with the diameter of the conductor that is to be marked.
Figure 9B:
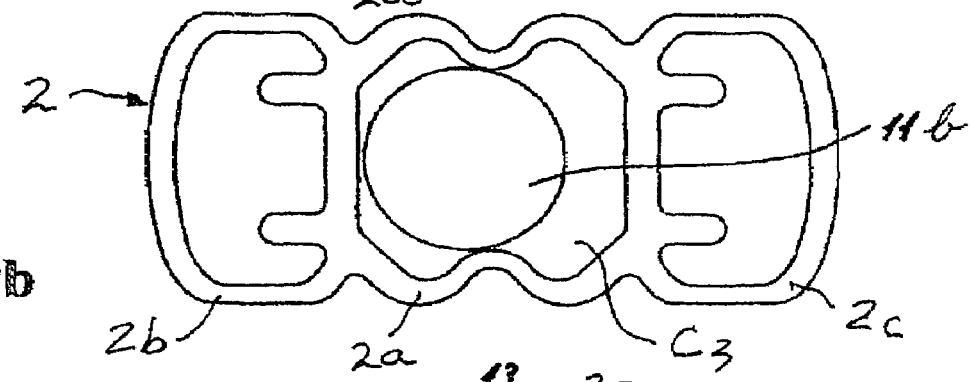
Figure 9C:
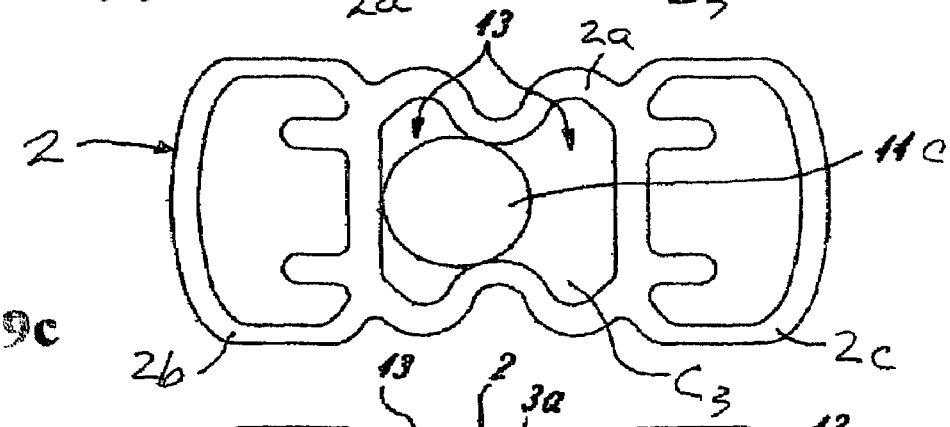
Figure 9D:
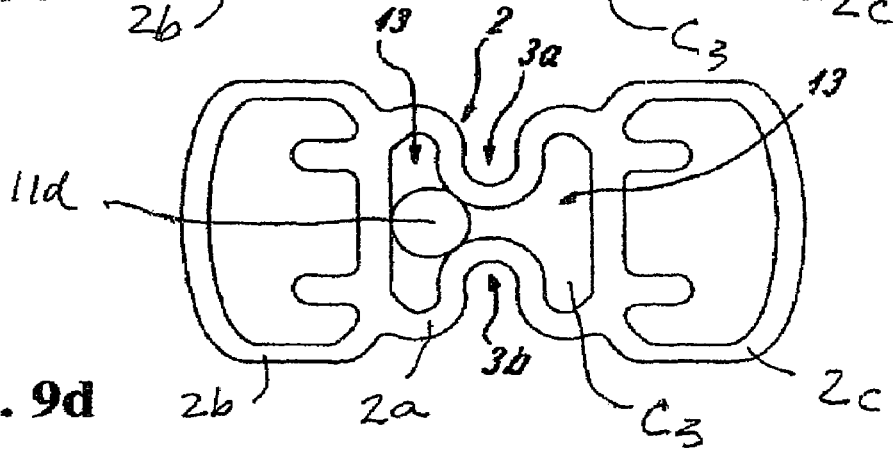

The receiving pocket portions 4, 5, 6 and 7 are preferably made of transparent synthetic material, and the other basic body 2 could made of a possibly nontransparent synthetic substance. Depending on the particular purpose, the pockets portions are distributed at random on basic body 2, for example, symmetrically with respect to a symmetry plane S or also asymmetrically with respect to that plane (for example, offset with respect to each other by 90°, whereby, according to FIGS. 7 and 8, in each case one of the receiving pocket portions 4, 5, 6 and 7, will lie directly opposite the creased portion 3 in the symmetry plane S and the other one will be laterally offset with respect to the symmetry plane S. The two or more pocket portions can also be used to display various information items (conductor end or start). The notches 10 (FIG. 2) are used for the insertion and stabilized support of the indicia-bearing marking tags 9.

Referring now to FIGS. 9*a*-9*d*, according to another modification, the marking device is deformable to vary the size of the main central opening in accordance with the diameter of the conductor 11*a*-11*d* that is to be marked for identification. This conductor marking device 1 again has a deformable main marker body member 2 including a central portion 2*a* having a generally square configuration in the initial non-deformed state, and two wing portions 2*b*, 2*c* arranged on opposite sides of the body member central portion, said wing portions respectively containing pocket openings 4 and 5 that are arranged with an offset of 180°, i.e., that are diametrically opposite each other on the main body member 2. Tag support projections 14 extend outwardly away from the body member central portion into the pocket openings 4 and 5. The body member wing portions 2*b* and 2*c* are connected with the central portion 2*a* by a pair of body member bridging portions 12 defined by the central opening $C_3$.

In each of these two material bridging portions 12 of main body member 2, there is inserted in each case a creased portion 3*a* and 3*b*, which are preferably offset by 180° with respect to each other on main body member 2 in a mirror-image symmetrical arrangement with respect to the plane E that extends axially through the marking sleeve or that are diametrically opposite each other upon the main marker body member 2.

Thus, in a simple manner and with few means, one can thus make a compact conductor marking sleeve where, by means of a "double" adjustment area of the two inwardly creased portions 3*a* and 3*b*, one can insert conductors 11*a*-11*d* with different diameters.

The smaller the diameter (see the progressing transition from FIGS. 9*a* to 9*d*), the further will an inserted conductor be clamped into one of the "receiving spaces" 13 laterally with respect to the ends of the creased portions 3 that are directed at each other so that also very thin (FIG. 9*d*) or very large diameters (FIG. 9*a*) can be securely accommodated, whereby in the latter case, the two creased portions 3 can definitely be stretched. The two receiving pockets 4, 5 thus afford easy "all-around recognizability" of the inserted marking tags.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A marking device for identifying an electrical conductor, comprising:

(a) a planar body member (2) having a generally-square central body portion (2*a*), and a pair of integral wing portions (2*b*, 2*c*) on opposite sides of said central body portion;

(b) said central body portion containing a central opening ($C_3$) that defines a pair of opposed bridging portions (12) connected between said wing portions;

(c) said body member wing portions containing pocket openings (4, 5) for receiving indicia-bearing tags (9), respectively;

(d) said body members bridging portions containing first and second inwardly directed creased portion (3*a*, 3*b*), respectively;

(e) said body member bridging portions being formed from a deformable synthetic plastic material such that when a conductor (11) is inserted axially into said central opening, said bridging portions may be deformed toward each other toward positions in engagement with the outer peripheral surface of the conductor, thereby to adjust the size of said central opening in accordance with the diameter of the conductor inserted into said central opening.

2. A marking device as defined in claim 1, wherein said first and second creased portions are arranged diametrically opposite each other.

3. A marking device as defined in claim 1, wherein each of said body member wing portions includes at least one support projection (14) that extends into the associated pocket opening to support an indicia-bearing tag (9) introduced into said pocket opening.

4. A marking device as defined in claim 1, wherein said body member wing portions are formed from a transparent synthetic plastic material.

* * * * *